US005850658A

United States Patent [19]

Specht

[11] Patent Number: 5,850,658

[45] Date of Patent: Dec. 22, 1998

[54] WRINGABLE MOP

[75] Inventor: Paul B. Specht, Wilmette, Ill.

[73] Assignee: Freudenberg Household Products LP, River Grove, Ill.

[21] Appl. No.: 851,054

[22] Filed: May 5, 1997

Related U.S. Application Data

[63] Continuation of Ser. No. 583,952, Jan. 11, 1996, abandoned.

[51] Int. Cl.[6] ..... A47L 13/142

[52] U.S. Cl. ..... 15/120.1; 15/229.1

[58] Field of Search ..... 15/120.1, 120.2, 15/119.1, 228, 229.1, 229.2, 229.6

[56] References Cited

U.S. PATENT DOCUMENTS

| | | | |
|---|---|---|---|
| Re. 15,274 | 1/1922 | Kenner | 15/120.2 |
| D. 384,458 | 9/1997 | Schroeck et al. | D32/51 |
| 429,835 | 6/1890 | Bateman | 15/120.2 |
| 739,786 | 9/1903 | Lay | 15/229.1 |
| 780,945 | 1/1905 | Fenton | 15/147.1 |
| 973,491 | 10/1910 | Fisher, Jr. | 15/120.2 |
| 1,126,887 | 2/1915 | Scott | 15/120.2 |
| 1,475,083 | 11/1923 | Portner | 15/120.2 |
| 1,494,871 | 5/1924 | Watkins et al. | 15/120.2 |
| 1,514,051 | 11/1924 | Jumonville | 15/120.2 |
| 1,520,500 | 12/1924 | Jumonville | 15/120.2 |
| 1,567,319 | 12/1925 | Leclerc et al. | 15/120.2 |
| 1,924,817 | 8/1933 | Tatter | 15/120.2 |
| 1,937,141 | 11/1933 | Carlson | 15/120.1 |
| 2,042,892 | 6/1936 | Granger | 15/120.2 |
| 2,059,773 | 11/1936 | Buell | 15/120.2 |
| 2,185,502 | 1/1940 | Fatland | 15/120.2 |
| 2,230,101 | 1/1941 | Bakemeier | 15/120.2 |
| 2,495,846 | 1/1950 | Johnson | 15/120.1 |
| 2,835,914 | 5/1958 | Littleton | 15/229.1 |
| 3,150,400 | 9/1964 | Fungaroli | 15/120.2 |
| 3,278,977 | 10/1966 | Makar | 15/120.2 |
| 3,334,369 | 8/1967 | Makar | 15/120.2 |
| 3,669,603 | 6/1972 | Keller et al. | 425/326 |
| 4,130,910 | 12/1978 | Raven | 15/120.1 |
| 4,178,650 | 12/1979 | Aasland | 15/120.2 |
| 4,479,278 | 10/1984 | Heinonen | 15/120.2 |
| 5,509,163 | 4/1996 | Morad | 15/120.2 |
| 5,538,327 | 7/1996 | Martorella et al. | 300/21 |
| 5,615,442 | 4/1997 | Schroeck et al. | 15/147.1 |

FOREIGN PATENT DOCUMENTS

| | | |
|---|---|---|
| 104093 | 2/1917 | United Kingdom . |
| 1300709 | 12/1972 | United Kingdom . |
| WO 95/07046 | 3/1995 | WIPO . |

*Primary Examiner*—Gary K. Graham
*Attorney, Agent, or Firm*—Leydig, Voit & Mayer, Ltd.

[57] ABSTRACT

A wringable string mop has a latch and ratchet assembly mounted between an elongate handle and an operating member slidably mounted on the handle to latch the operating member in a position wherein the strings extend along and around the lower end of the handle and the operating member and the handle may be incrementally ratcheted relative to one another to twist and wring out the mop.

8 Claims, 4 Drawing Sheets

WRINGABLE MOP

This is a continuation of application Ser. No. 08/583,952 filed on Jan. 11, 1996 now abandoned.

The present invention relates in general to mops of the type which incorporate means for twisting the mop element to wring liquid therefrom, and it relates more particularly to a new and improved floor mop including a manually releasable, unidirectional rotational mechanism which facilitates twisting of the mop element into a tightly wound condition wherein substantially all of the liquid which has been absorbed by the mop element during use thereof is wrung from the mop element.

BACKGROUND OF THE INVENTION

Commercially available string mops have incorporated means for twisting the strands of the mopping element around the mop handle to expel from the strands the washing or rinsing liquid which had been absorbed thereby during use of the mop. One problem associated with these prior art mops is the fact that a considerable amount of strength is required to physically hold the mop parts in the wringing condition and simultaneously to twist the mop element to expel substantially all of the liquid therefrom to leave the mop element in a substantially dry state. Many persons, such as the elderly, the very young, those with arthritis, and other infirmities cannot wring out such mops.

In order to reduce the overall angle through which the ends of the mop element must be twisted to wring a substantial amount of the liquid from the mop element, it has been the practise to utilize relatively short liquid absorbent strands, but this has resulted in a small surface area of the mop element which is available to contact the floor or other surface to be mopped.

SUMMARY OF THE INVENTION

Briefly, there is provided in accordance with the present invention a new and improved mop construction having a spring loaded releasable latch mounted to an elongated mop handle for engagement with a manual operating member telescopically mounted to the mop handle. The mop includes a mop element comprising a plurality of liquid absorbent strands, which are preferable made of a plurality of fiber strings. One end of the mop element is connected to the lower end portion of the mop handle and the other end is connected to the lower end portion of the operating member. The latch mechanism includes a pair of ratchet elements which engage a mating gear element on the operating member when the operating member and the handle are in the wringing condition to permit only unidirectional rotation of the operating member relative to the mop handle. As a consequence, the operating member may be rotated relative to the handle in very small angular increments which greatly facilitates tightly twisting the mop element. A mop incorporating the invention is superior to those mops which require the user to hold the mop element in the wringing position while simultaneously rotating the ends of the mop element through a substantial angle which is normally well in excess of one-hundred eighty degrees.

Another feature of the present invention is the use of sufficiently long liquid absorbent strands to provide a mopping element of reduced width at the lower end of the mop handle when the operating member is in the wringing position. This permits use of the mop in hard to reach, narrow places.

GENERAL DESCRIPTION OF THE DRAWINGS

The present invention will be better understood from a reading of the following detailed description of the invention taken in connection with the accompanying drawings wherein.

DETAILED DESCRIPTION OF A PREFERRED EMBODIMENT OF THE INVENTION

Figure 1:
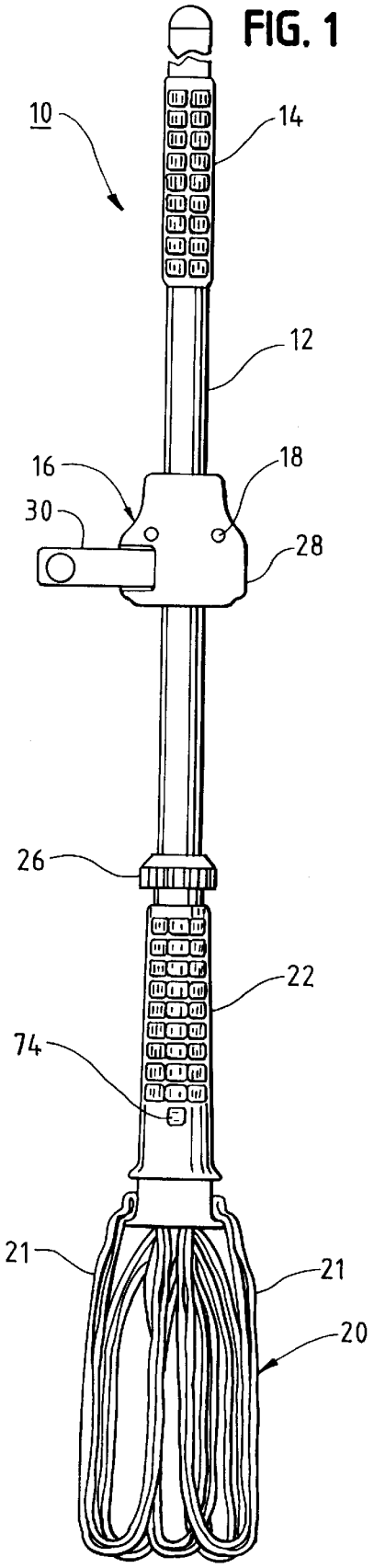
FIG. 1 is an elevational view of a string mop embodying the present invention, the mop being shown in the mopping condition.

Referring to the drawings and particularly to FIG. 1, A mop 10 may be seen to include an elongate handle member 12 having a comfortable hand grip 14 mounted thereto near the upper end thereof. A combined latch and ratchet device 16 is fixedly mounted to the handle 12. A relatively limp mopping element 20 comprises by a plurality of separate loops 21 of a liquid absorbent fibrous material. While strings of stranded fibers are believed to be preferable, strands of any other suitable limp material such as strips of liquid absorbent material may be used in place of the string loops. One end of the mop element is affixed to the bottom of the handle 12 in the manner more fully described hereinafter, and the other end of the mop element is affixed to the bottom of an operating member 22 in the manner described hereinafter.

The operating member 22 is telescopically mounted over the lower portion of the mop handle 12 below the latching device 16 and is axially slidable along the handle 12 from a lower first position shown in FIG. 1, the mopping position, and an upper second position shown in FIG. 2. When the operating member is in the second position, the mop may be used for mopping in narrow places as well as stored. When in the upper second position the mop element may be twisted to wring out and thus expel any liquid which had been absorbed by the absorbent strands of the mopping element.

The operating member 22, like the grip 14, has comfortable hand grip surfaces 24 on opposite sides thereof, and includes an integral ratchet type gear 26 having a central bore through which the handle 12 slidably extends. The gear 26 is located at the top of the operating member 22 and is fully positioned within the housing of the latch and ratchet device 16 when the operating handle is in the upper or second position as shown in FIG. 2. The teeth 27 of the gear 26 have ramped outer surfaces.

Figure 3:
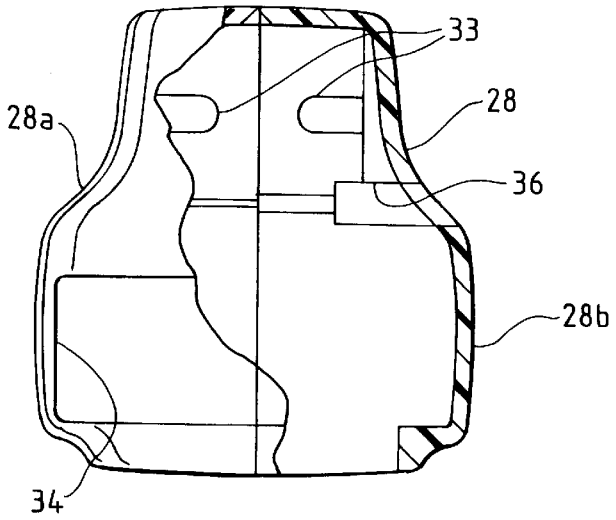
FIG. 3 is an elevational view, partially broken away, of the latch and ratchet housing as shown in FIG. 1.
Figure 4:
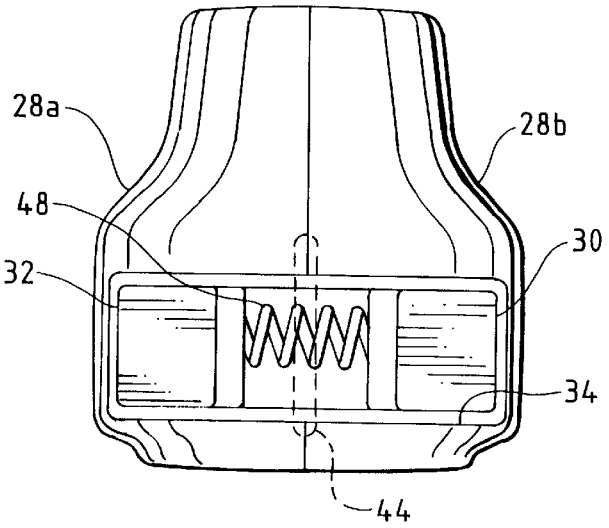
FIG. 4 is an elevational view, partially broken away, of the latch and ratchet housing taken from a direction ninety degrees from that shown in FIG. 3.

Referring to FIGS. 3 and 4, the latch and ratchet mechanism 16 comprises a housing 28, suitably molded of plastic, from which extends a pair of fingers 30 and 32 which are adapted to be manually squeezed together to release the gear 26 from the remainder of the mechanism 16 to permit the operating handle and the associated end of the mop element to drop under the force of gravity into the mopping position as shown in FIG. 1.

As best shown in FIG. 3, the latch housing 28 is formed of two mating pieces 28*a* and 28*b* which respectively have an internally extending radial finger 33 which fits into a transverse hole through the handle 12 when the housing parts are assembled together around the handle 12. The parts 28*a* and 28*b* may be connected together in any suitable manner such as by a pair of screws or rivets which extend through openings 36 in the housing member 28*b*.

Figure 5:
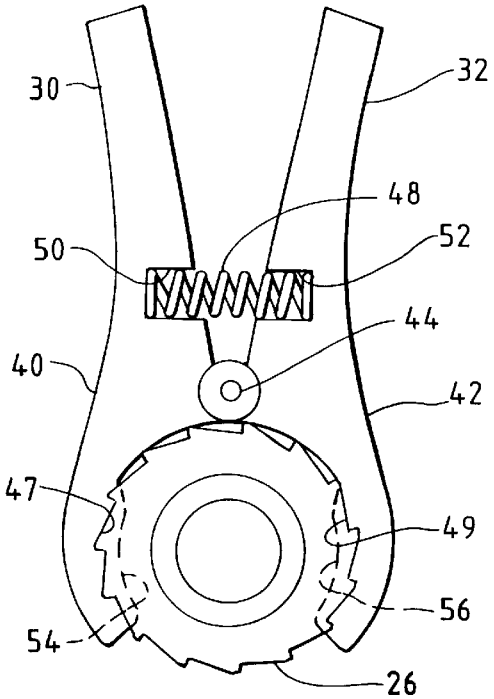
FIG. 5 is a top view of the latch and ratchet assembly.

A ratchet element comprises a pair of caliper jaws 40 and 42 which are pivotably connected together and to the housing 28 by means of a pivot rod 44 which is locked in place within the latch housing between the housing parts 28*a* and 28*b* with the upper and lower ends of the pivot rod extending into mutually aligned blind holes 46 and 48 in the housing parts 28*a* and 28*b*. Internally disposed ratchet teeth 47 and 49 having ramp surfaces are provided on the jaws 40 and 42 and as shown in FIG. 5 mate with the teeth of the gear 26 when the operating member 22 is in the upper wringing position with the gear 26 located within the jaws. The jaws 40 and 42 are spring loaded into the latching position shown in FIG. 5 by a coil spring 48 which is compressed between the bottoms of a pair of opposing blind holes 50 and 52 in the handle portions 30 and 32 of the jaws 40 and 42.

Figure 6:
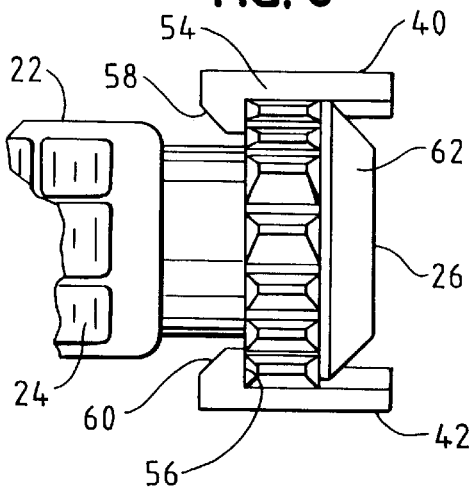
FIG. 6 is an elevational view of the latch and ratchet assembly taken from the bottom of FIG. 5.
Figure 7:
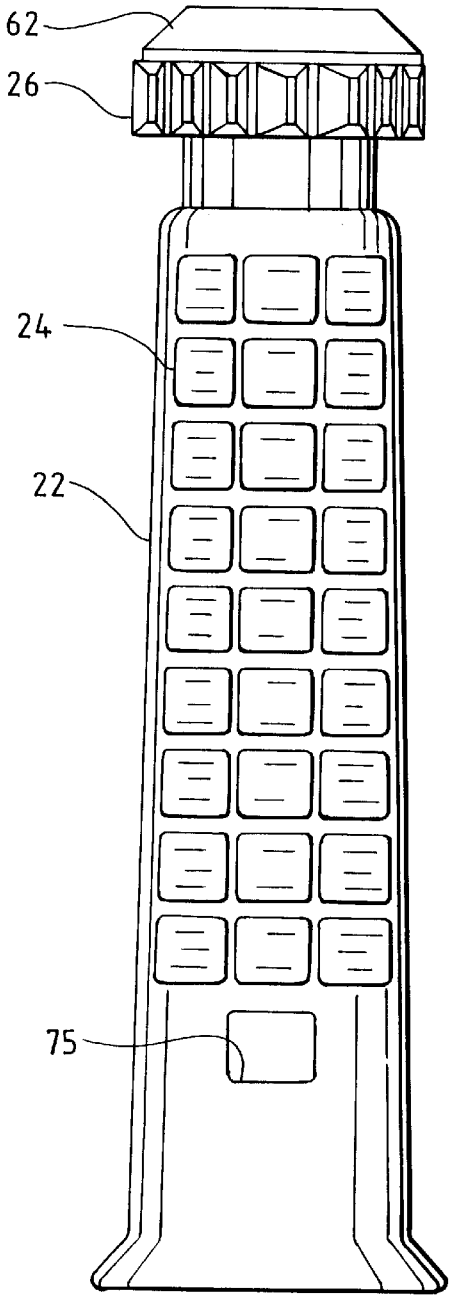
FIG. 7 is an elevational view of the operating member.

The jaws further include inwardly extending shelves or shoulders 54 and 56 which as best shown in FIG. 6 are adapted to extend a short distance beneath the lower face or shoulder 57 of the gear 26 to hold the operating member 22 in the upper wringing position. The bottom surfaces of the shoulders 54 and 56 are tapered inwardly and upwardly to provide ramp surfaces 58 and 60 which spread the jaws 40 and 42 apart as the upper frustoconical ramp surface 62 at the top of the gear 26 is pushed past the shoulders into the upper wringing position in engagement with the teeth of the caliper ratchet jaws. When the lower end of the gear 26 moves above the shoulders 54 and 56, the spring 48 presses the teeth of the jaws into engagement with the teeth of the gear 26.

It will thus be seen that the operating handle is thus locked by the shoulders 54 and 56 in the wringing position with the gear in engagement with the caliper jaws. The person using the mop in this position, either for mopping, storage or wringing, is not required to exert any force to prevent the removal of the operating handle from this position.

Figure 8:
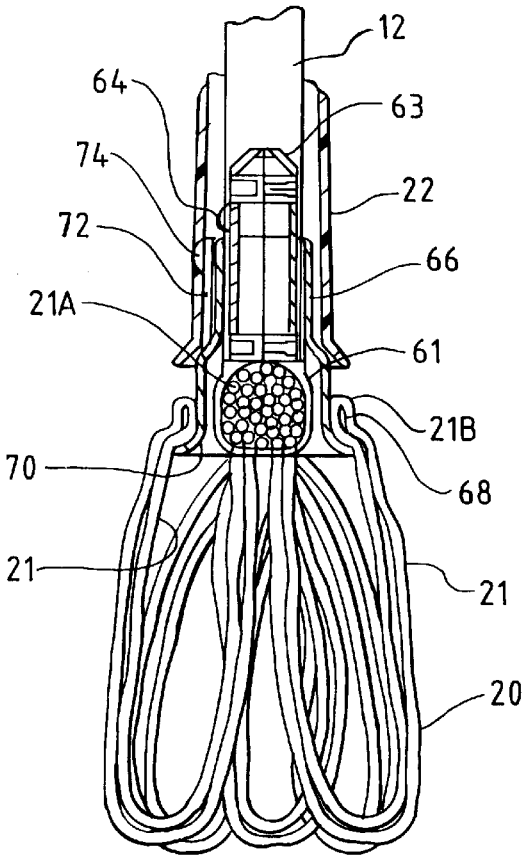
FIG. 8 is a cross-sectional view of the mop element and the connectors by which each of its ends are attached.

As described hereinabove, one end of the mopping element 20 is removably attached to the lower end of the mop handle 12. Referring to FIG. 8, it may be seen that the central portions 21A of the loops 21 extend through and are held together by a ring 61 which is integral with and located at the bottom of a generally cylindrical plastic connector member 63 which is fitted into the lower end of the handle 12. An external button 64 on the connector member 63 is adapted to snap into a transverse opening in the handle 12 when the member is fully inserted into the lower end of the handle to hold the central portion of the mop element in the handle and to prevent relative rotation between the connector member 63 and the handle 12. In order to release the connector member 63 and the mop element from the handle 12, it is merely necessary to push in the button 64 and pull the connector member 63 free from the handle 12.

Figure 9:
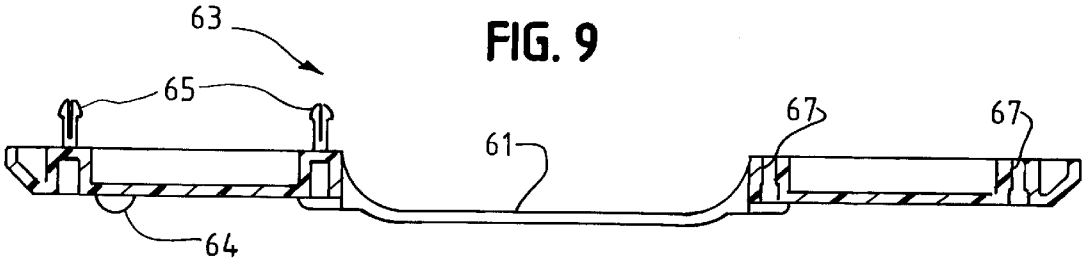
FIG. 9 is a view of one of the connector members shown in FIG. 8 prior to final assembly of the connector member.
Figure 10:
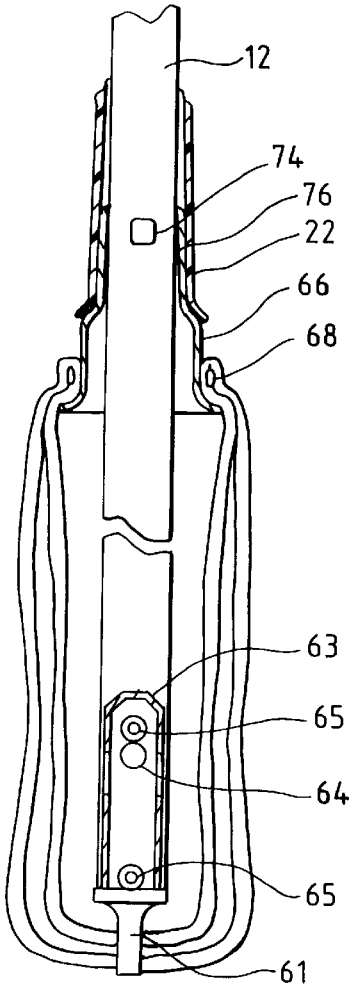
FIG. 10 is an elevational view the mop element and connectors in the wringing position.
Figure 11:
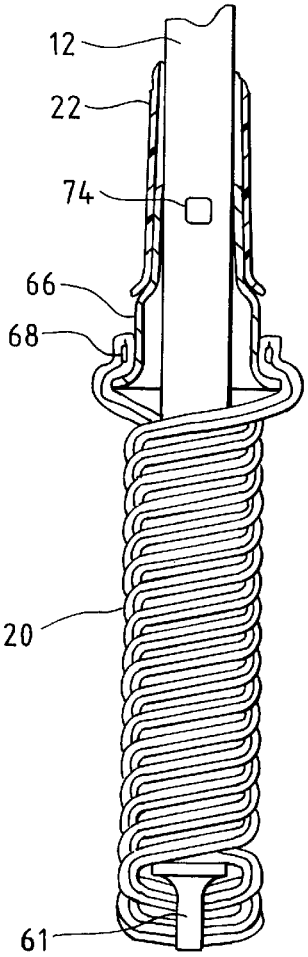
FIG. 11 is an elevational view of the mop element and connectors with the mop element in a fully twisted condition.

Referring to FIG. 9, it may be seen that the connector member 63 is a unitary member having sections which are adapted to be folded onto one another with the central portion providing the ring 61 which is thus formed over the loops 21 and snapped locked in the ring condition by integral pins 65 which fit into corresponding counterbored holes 67 to provide the completed assembly shown in FIG. 8.

The other ends 21B of the loops 21 are positioned around a second connector member 66 by means of a flexible plastic tie strap 68 which during assembly is threaded through the loops 21 and subsequently tightened tightly to fasten the loops 21 around the connector member 66. The lower end 70 of the connector member 66 is outwardly flared to prevent the loops and the strap 68 from slipping off the lower end of the connector member 66.

The connector member 66 is a generally tubular plastic member which includes an upwardly extending resilient finger 72 having an outwardly protruding button 74 at the top which is adapted to snap into a transverse opening in the operating member 22, as best shown in FIG. 8, when the connector 66 is inserted into the lower end of the operating member 22. An sleeve 76 at the upper end of the connector member 66 has an internal diameter slightly greater than the external diameter of the handle 12 but less than that of the ring 61 on the connector member 63, whereby the connector member 66 and the operating member 22, which is connected thereto, are prevented from slipping off the lower end of the mop handle 12. In addition to releasably locking the connector member 66 to the operating member 22 the button 74 prevents relative rotation between the connector element 66 and the operating member 22.

OPERATION

Figure 2:
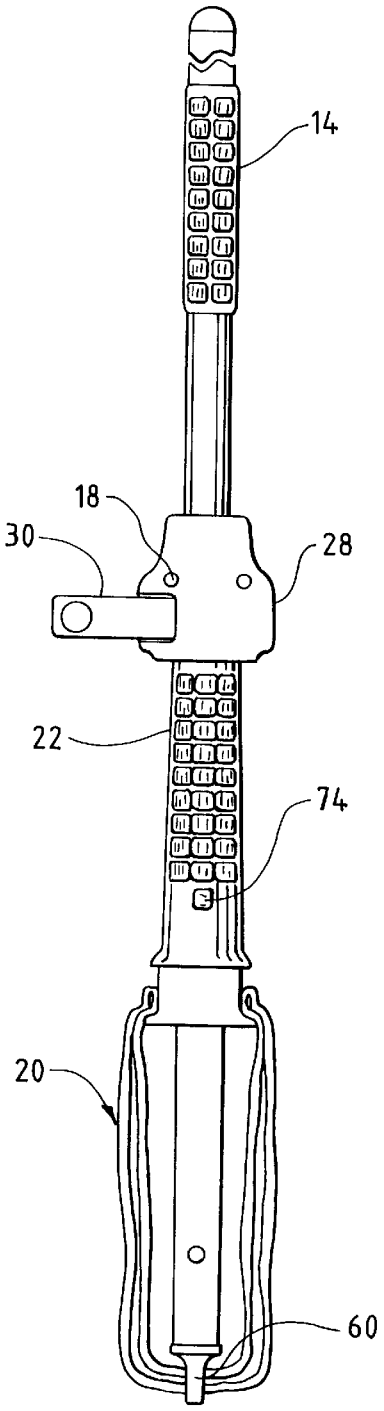
FIG. 2 is an elevational view similar to that of FIG. 1, but showing the mop in the wringing condition.

When holding the mop in the upright position as shown in FIG. 2, the person intending to mop a floor, squeezes the finger grips 30 and 32 together to release the latch by moving the shoulders 54 and 56 from beneath the gear 26. The operating member 22 will then fall by gravity into the mopping position illustrated in FIG. 1 with the mop element 20 hanging below the bottom of the mop handle 12.

When the user desires to wring out the mop element 20, he or she grasps the handle with one hand above the latch device 16 and with the other hand grasping the operating member 22 and pulls the gear 26 up into the latch device. As the gear moves between the jaws 40 and 42 it spreads the jaws to permit the gear to move past the shoulders 54 and 56 and is latched in the upper position with the gear 26 in engagement with the ratchet teeth 47 and 49 on the jaws 40 and 42. While holding the handle 12 in one hand and the operating member 22 in the other hand, the user then twists the operating member 22 relative to the main handle 12 to twist the mop element around the lower end portion of the handle 12. Because of the ratchet which permits only unidirectional rotation of the operating member 22 relative to the handle 12. the twisting may, if desired, be carried out in small increments each requiring the application of very little force. On the other hand, if the user wishes to completely twist the mop element in just one or two substantial angular increments, he or she can simply do that.

It may be seen that when the operating member 22 is in the uppermost position, a small part of the mop element 20 is disposed below the lower end of the handle 12 and remains in that position even after the operating member 22 has been twisted relative to the handle 12. The portion of the mop element 20 which is located below the lower end of the handle 12 can be used as a mop to reach and to wash, scrub and rinse relatively narrow areas into which the entire mop element 20 would be too large to fit with the operating member 22 in the down position.

After the mop element has been wrung out to expel the washing or rinsing liquid therefrom, the mop element remains tightly wound around the mop handle and thus occupies only a small space, and where storage space is at a premium, the mop my be conveniently stored in this condition. until it is to be used again.

In order to replace the mop element, the operating member 22 is released from the latch device 16 by squeezing the finger grips 30 and 32 together, and then the button 74 is depressed to release the connector member 66 from the lower end of the operating member 22. Thereafter the button 64 is exposed and may be easilly depressed to release the connector 62 from the handle 12 to permit withdrawal of the connector member 66 from the lower end of the handle 12. A fresh mop element 20 with the connector members 63 and 66 previously attached thereto by the manufacturer may then be attached to the handle 12 and the operating member 22 by simply inserting the connector members 63 and 66 into the lower ends of the handle 12 and operating member 22 in the proper angular positions to permit the buttons 64 and 74 to snap into place in the locking positions thereby latching the connectors to the handle and to the operating member. Preferably, alignment means are provided in the lower end portions of the members 12 and 22 to facilitate the angular alignment of the buttons 64 and 74 with the respective transverse openings in the handle 12 and the operating member 22 as the connectors are inserted into the associated members.

The present invention has been described in connection with a preferred embodiment thereof, but it will be understood that many changes and modifications may be made by those skilled in the art without departing from the true spirit and scope of the invention. Therefore, it is intended by the claims appended hereto to cover all such changes and modifications which come within the true spirit and scope of the invention.

I claim:

1. A mop comprising in combination:

an elongate handle member, an operating member mounted in axially movable relationship to said handle member over a range of travel between a mopping position and a latch position, a plurality of elongate liquid absorbent members constituting a mopping element, said mopping element having a first end portion connected to a distal end portion of said handle member, and an opposite second end portion connected to said operating member, a shoulder on one of said handle member and said operating member, and releasable latch means on the other of said handle member and said operating member for releasebly engaging said shoulder for locking said handle member and said operating member together with said operating member in said latch position, wherein said handle member and said operating member are rotatable relative to one another to permit twisting of said mop element when said operating member is in said latch position, whereby liquid absorbed by said liquid absorbent elements can be wrung out of said elements by positioning said operating member in said second position and then rotating said handle member and operating member relative to one another, the mop further comprising a ratchet mechanism operating to prevent relative rotation of said handle member and said operating member when said operating member is in said latch position, said ratchet comprising a ring of external ratchet teeth mounted to said operating member and a spring loaded pawl mounted to said handle member, said ring of external ratchet teeth and said pawl being in interconnected operative relationship when said operating member is in said latch position, wherein said spring loaded pawl is biased to mate with said ring of external ratchet teeth when said operating member is in said latch position.

2. A mop according to claim 1, wherein said ring of external ratchet teeth and said shoulder have mutually engagable camming surfaces which enable said operating member to be moved into said latch position and said operating member to be locked in said latch position by the manual pushing of said ring of external ratchet teeth into engagement with said pawl.

3. A mop according to claim 1 wherein said spring loaded pawl has a plurality of teeth which simultaneously engage a plurality of teeth on said ring of external ratchet teeth when said operating member is in said latch position.

4. A mop according to claim 3, wherein said ratchet mechanism comprises a pair of spring loaded jaws operating opposite one another, said pawl being disposed on one of said spring loaded jaws.

5. A mop comprising in combination:

an elongate handle, a tubular operating member telescopically mounted to said handle for axial and rotational movement relative to said handle, said operating member having a first end and a second end, a mop element having a first end and a second end, a first connector for removably attaching said first end of said mop element to said operating member, a second connector for removably attaching said second end of said mop element to a distal end of said handle, first mutually engagable latching means mounted to said handle and to said operating member for releasably locking said operating member to said handle against axial movement relative to said handle, second mutually engagable latching means mounted to said operating member and to said first connector for releasably locking said first connector to said operating member, a first latching and ratchet means disposed on said operating member, a second latching and ratchet means fixedly mounted to said handle at a position remote from said distal end, said first and second latching and ratchet means being mutually engagable for preventing relative axial movement and for permitting unidirectional rotational movement between said operating member and said handle when said operating member is positioned with said first and second latching and ratchet means in mutual interengaging relationship, and manually operative means for disengaging said first and second latching and ratchet means from one another to permit relative axial and bi-directional rotational movement between said operating member and said handle.

6. A mop according to claim 5, wherein said first latching and ratchet means comprises a plurality of annularly disposed ratchet teeth and an annular shoulder, said second latching and ratchet means comprises first and second pivotally mounted jaws having internal ratchet teeth engagable with said annularly disposed ratchet teeth of said first latching and ratchet means and a latching shoulder engagable with said shoulder of said first latching and ratchet means, spring means biasing said jaws into one or more latching positions wherein said annular shoulder on said first latching and ratchet means is in mutually latching engagement with said latching shoulder on said jaws and said ratchet teeth on said jaws are in engagement with said ratchet teeth of said first latching and ratchet means, and squeezable finger grips on said jaws for moving said jaws out of said one or more latching positions.

7. A mop comprising in combination:

an elongate handle member, an operating member mounted in axially movable relationship to said handle member between a first mopping position and a second position, a plurality of elongate liquid absorbent members constituting a mopping element, said mopping element having a first end portion connected to a distal end portion of said handle member, and an opposite second end portion connected to said operating member, a movable locking member on one of said handle member and said operating member, said movable locking member movable between a locking condition and a release condition, a shoulder on the other of said handle member and said operating member for engagement by said movable locking member, and ramp means adjacent said shoulder on said other of said handle and said operating member for opening said locking member to enable receipt of said shoulder when said operating member is moved to said second position.

8. A mop comprising in combination:

an elongate handle member, an operating member mounted in axially movable relationship to said handle member between a first mopping position and a second position, a plurality of liquid absorbent members constituting a mopping element, said mopping element having a first end portion connected to a distal end portion of said handle member, and an opposite second end portion connected to said operating member, a first shoulder on one of said handle member and said operating member, said handle member and said operating member rotatable relative to one another to permit twisting of said mop element when said operating member is in said second position, a first ratchet means mounted to said operating member, and a second ratchet means mounted to said handle member, one of said first ratchet means and said second ratchet means comprising a first movable jaw, at least one tooth on said movable jaw for engagement with the other of said first ratchet means and said second ratchet means, a second shoulder on said movable jaw for releasable engagement with said first shoulder means for locking said handle member and said operating member together with said operating member in said second position, wherein said liquid absorbent members extend partially around said distal end portion of said first handle member, and further comprising a second movable jaw opposite said first movable jaw.

* * * * *

UNITED STATES PATENT AND TRADEMARK OFFICE

CERTIFICATE OF CORRECTION

PATENT NO. : 5,850,658
DATED : December 22, 1998
INVENTOR(S) : SPECHT

It is certified that error appears in the above-identified patent and that said Letters Patent is hereby corrected as shown below:

ON THE TITLE PAGE:

[73] Assignee: "*Freudenberg Houselhold*" should read --*Freudenberg Household*--.

In Column 1, line 29: "*practise*" should read --*practice*--.

In Column 4, line 19: "*An sleeve*" should read --*A sleeve*--.

In Column 5, line 12: "*easilly*" should read --*easily*--.

In Column 5, line 24: "*members 12 and 22*" should read --*handle 12 and operating member 22*--.

Signed and Sealed this

Third Day of August, 1999

*Attest:*

Q. TODD DICKINSON

*Attesting Officer*

*Acting Commissioner of Patents and Trademarks*